US009407011B2

(12) United States Patent
Zaghloul et al.

(10) Patent No.: US 9,407,011 B2
(45) Date of Patent: Aug. 2, 2016

(54) BROADBAND ELECTROMAGNETIC BAND-GAP (EBG) STRUCTURE

(71) Applicant: U.S. Army Research Laboratory, Adelphi, MD (US)

(72) Inventors: Amir I. Zaghloul, Bethesda, MD (US); Steven J. Weiss, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 337 days.

(21) Appl. No.: 13/713,030

(22) Filed: Dec. 13, 2012

(65) Prior Publication Data

US 2013/0214984 A1 Aug. 22, 2013

Related U.S. Application Data

(60) Provisional application No. 61/601,584, filed on Feb. 22, 2012.

(51) Int. Cl.

| | |
|---|---|
| ***H01Q 19/30*** | (2006.01) |
| ***H01Q 19/10*** | (2006.01) |
| ***H01Q 15/14*** | (2006.01) |
| ***H01Q 15/00*** | (2006.01) |

(52) U.S. Cl.
CPC ..... *H01Q 19/10* (2013.01); *H01Q 15/008* (2013.01); *H01Q 15/14* (2013.01); *H01Q 19/108* (2013.01)

(58) Field of Classification Search
CPC ..... H01Q 19/10; H01Q 15/04
USPC ..... 343/819, 834, 891, 892, 818, 700 MS; 257/665
See application file for complete search history.

(56) References Cited

U.S. PATENT DOCUMENTS

| | | | | |
|---|---|---|---|---|
| 4,347,287 | A * | 8/1982 | Lewis et al. | 428/378 |
| 4,912,481 | A * | 3/1990 | Mace et al. | 343/700 MS |
| 8,228,256 | B2 * | 7/2012 | Puente Baliarda et al. | 343/844 |
| 8,514,147 | B2 * | 8/2013 | Konishi et al. | 343/909 |
| 8,789,848 | B2 * | 7/2014 | Takagi | 280/743.1 |
| 2004/0140945 | A1 * | 7/2004 | Werner et al. | 343/909 |
| 2005/0029632 | A1 * | 2/2005 | McKinzie et al. | 257/665 |
| 2010/0039343 | A1 * | 2/2010 | Uno et al. | 343/818 |

* cited by examiner

*Primary Examiner* — Huedung Mancuso
(74) *Attorney, Agent, or Firm* — Alan I. Kalb

(57) ABSTRACT

An electromagnetic bandgap structure comprising a progressive cascade of a plurality of patterns of cells. The cells of each pattern are dimensioned so that each pattern has a reflection phase response centered at a different, but closely-spaced, frequency compared with the reflection phase response of an adjacently positioned pattern, so that the combined reflection phase response of the plurality of patterns provides a continuous wideband operational range.

9 Claims, 7 Drawing Sheets

BROADBAND ELECTROMAGNETIC BAND-GAP (EBG) STRUCTURE

CROSS REFERENCE TO RELATED APPLICATIONS

This application claims benefit of U.S. provisional patent application Ser. No. 61/601,584, filed Feb. 22, 2012, which is herein incorporated by reference.

GOVERNMENT INTEREST

The invention described herein may be manufactured, used and licensed by or for the U.S. Government."

FIELD OF INVENTION

Embodiments of the present invention generally relate to electromagnetic band-gap (EBG) structures, and more particularly to EBG structures having a progressive cascade of patterns of EBG cells, which progressive cascade of patterns result in a continuous wideband operational phase response for the EBG structures, as well as antennas using such wideband EBG structures.

BACKGROUND OF THE INVENTION

Electromagnetic band gap (EBG) structures are periodic structures that have special properties, such as high surface impedance. Accordingly, a ground plane having EBG structures formed thereon can act as a close-to-perfect magnetic conducting structure, and therefore suppress the formation of surface waves. The reflection phase is important when EBG structures are used for designing an antenna because of the known consequence that the efficiency of the antenna is affected by destructive interference of the wave reflected from the ground plane with the wave directly radiated from the antenna. A conventional solution to this problem is to provide the antenna at a specified distance from the electric ground plane (that is, at one quarter wavelength of the center frequency) so that the reflected wave and the radiated wave constructively combine along the boresight of the antenna. Using a magnetic ground plane having EBG structures formed thereon in combination with an antenna is known so as to take advantage of the EBG characteristic of high impedance, and thereby allowing the construction of low-profile antennas. The reflection phase of such EBG structures when used in an antenna embodiment is such that it results in the constructive addition of the incident and reflected waves, thereby reducing backward radiation and enhancing forward radiation. Although EBG structures have been known in microwave design for more than two decades and are known to provide advantages due to their compact size and low loss when integrated into an antenna design, EBG structures typically work over a narrow frequency band, which makes them not practical for use with broadband antennas. The word "size" as used herein is not limited to a measure of physical characteristics, but also includes a measure of electrical characteristics.

It would be desirable to provide an electromagnetic band gap structure having a phase response suitable for use with a broadband antenna, that is, having an ultra-wideband (UWB) operational phase response which is greater than, for example, 500 MHz.

BRIEF SUMMARY OF THE INVENTION

Methods and apparatus for providing a broadband electromagnetic band gap (EBG) structure are provided herein. In some embodiments an apparatus for providing a broadband EBG structure includes a progressive cascade of patterns, of EBG cells, each pattern having a resonance at a different, but closely-spaced frequency compared with an adjacently positioned pattern. In some embodiments this is accomplished by using one of either a concentric arrangement or a symmetric parallel arrangement of patterns of EBG cells, each pattern having a basic cell size, which size progressively changes the further the pattern is positioned from a central point of the EBG structure, so as to cause a progressive change in resonance for adjacently positioned patterns. The combined effect of this progressive cascade arrangement is a continuous ultra wide operational bandwidth for the EBG structure. In some embodiments the progressive cascade of patterns are provided as a single level structure, and in other embodiments, each pattern is provided on a different level. These and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 2:
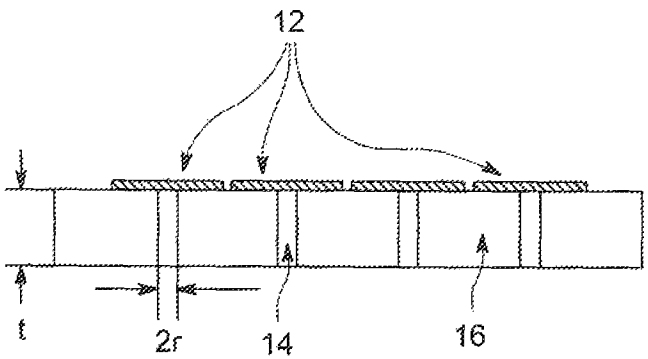
FIG. 2 illustrates a side view of the 2×2 patch mushroom EBG structure shown in FIG. 1.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION OF THE INVENTION

The present invention describes embodiments for a broadband electromagnetic bandgap (EBG) structure and use of that structure in an antenna application. The invention derives from a progressive cascade of patterns of EBG structures, each pattern having a progressively increasing resonant frequency, so that the combined effect of the cascade structure provides a continuous ultra-wide broadband phase response. The new structure is validated by using it in combination with a broadband antenna and comparing the performance of the antenna with a uniform EBG ground plan structure and then with a broadband EBG ground plane structure having a progressive cascade of patterns as described herein.

Figure 1:
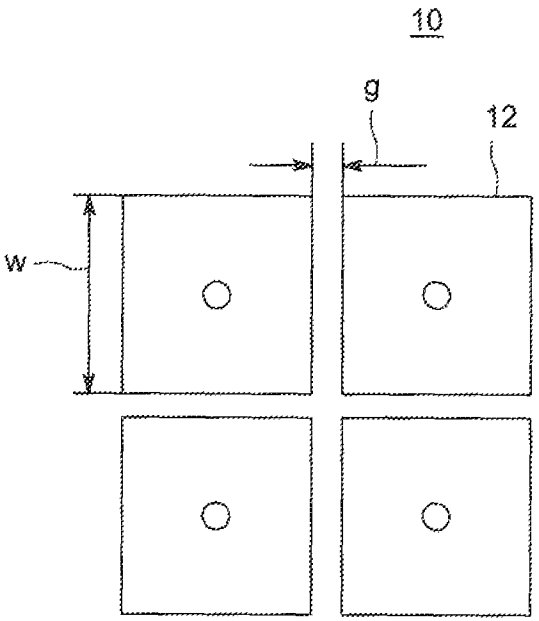
FIG. 1 illustrates a top view of a 2×2 patch mushroom EBG structure of a type useful for forming some embodiments of the invention.

Mushroom-like EBG structures have parallel LC resonators, such as shown in FIGS. 1 and 2 which illustrate top and side views, respectively of a 2×2 patch mushroom EBG structure 10 of a type useful for forming some embodiments of the invention. The structure includes a periodic conductive pattern of patches 12 centered over metallized vias 14 having a diameter (2r) formed in a dielectric board 16 having a thickness (t). Each patch and via comprise one EBG cell. The patches 12 are illustrated in this embodiment as squares having a uniform side dimension (w) which are separated by a gap distance (g). The inductance (L) of the resonator is represented by the metallized vias 14 and the capacitance (C) is represented by the gap (g) between the patches 12. At, the resonant frequency of the EBG structure, the surface impedance goes to infinity and thus acts like a perfect magnetic conductor (PMC). When the surface is used as the ground plane for an antenna, this effect causes the wave reflected from the ground plan surface to be "in-phase", and therefore constructively add with the direct wave radiated from the antenna. The result is an up to 3 DB improvement in antenna performance, as compared with the antenna in a free-space environment, and an even more significant improvement relative to an antenna over a ground plane surface that acts like a perfect electric conductor (PEC). A PEG ground plane surface provides an out-of-phase reflection (that is −180°) from its surface that destructively interferes with the direct wave radiated from the antenna. Although the reflection off of a PEG becomes coherent with the antenna radiation if the antenna is placed a quarter-wavelength above the PEC, placing the antenna a quarter-wavelength above the PEC results in an undesirable increase in height for the antenna arrangement.

The surface impedance of the mushroom EBG structure is calculated as shown in equation 1, while the inductance and capacitance of the EBG structure are calculated as shown in equations 3 and 4. The band gap of an EBG structure is defined as the frequency band where they reflection phase is within the +90 to −90° range.

$$Z_s = \frac{j\omega L}{1-(\omega/\omega_o)^2} \tag{1}$$

$$\omega_o = \frac{1}{\sqrt{LC}} \tag{2}$$

$$C = \frac{\varepsilon_o(1+\varepsilon_r)}{\pi}\cosh^{1-}\left(\frac{\omega+g}{g}\right) \tag{3}$$

-continued $$L = \mu_o t \tag{4}$$

It has been found that three or four different patterns of individual cell size are needed in the EBG structure to achieve the wide bandwidth phase performance desired in an antenna arrangement. This condition, although not mandatory, is satisfied in FIGS. 4, 6, 7, 8 and 9.

Figure 3:
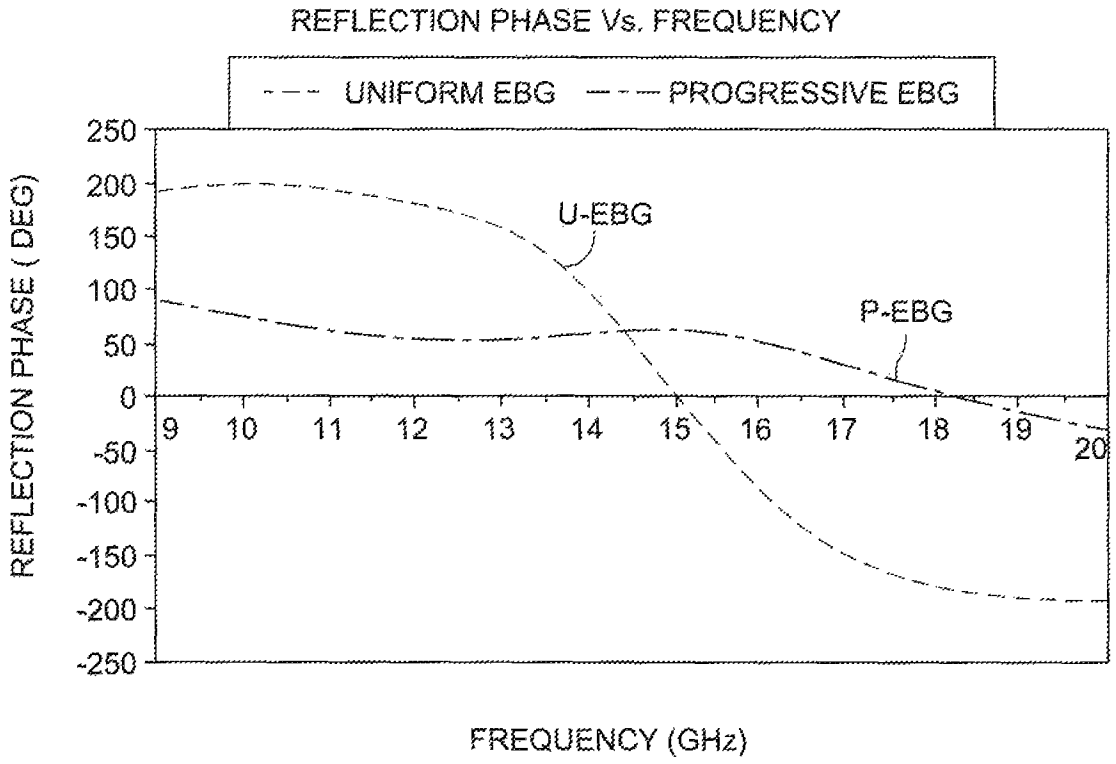
FIG. 3 illustrates a reflection phase comparison of a narrowband uniform EBG structure as compared with a progressive EBG structure constructed in accordance with embodiments of the invention.

FIG. 3 illustrates the phase response of a narrowband uniform EBG structure in accordance with the prior art, as compared with a progressive cascade EBG structure constructed in accordance with embodiments of the invention. As is readily apparent, a problem with the prior art EBG structure is that its operational effectiveness is relatively narrowband, while the present invention results in a phase response having a wide operational bandwidth.

In accordance with embodiments of the invention, in order to provide a phase response commensurate with that provided by a uniform EBG configuration but over a continuous wide frequency band (such as an ultra-wideband of greater than 500 MHz, for example), a cascade of a plurality of uniform EBG patterns are described herein. Each pattern comprises an array of cell structures having a basic size. The size of the cells of each pattern progressively changes the further the pattern is positioned from a central point of the EBG structure, so as to cause a progressive change in resonance for adjacently positioned patterns. The combined effect of this progressively changing cascade arrangement is a continuous ultra wide operational bandwidth for the EBG structure. Hereinafter this arrangement is referred to as a progressive cascade EBG structure. The progressive EBG structure results in a continuous band gap that is much wider compared to the band gap width of a uniform EBG structure, as evidenced by the reflection phase response comparison shown in FIG. 3. The progressive cascade of EBG structures shown in the embodiments herein have three concentric or symmetric parallel positioned uniform EBG structures which resonate at 12 GHz, 15 GHz and 18 GHz, respectively, although a different number of progressive uniform EBG patterns can be used and a different range and spacing of their resonant frequency can be used.

Figure 4:
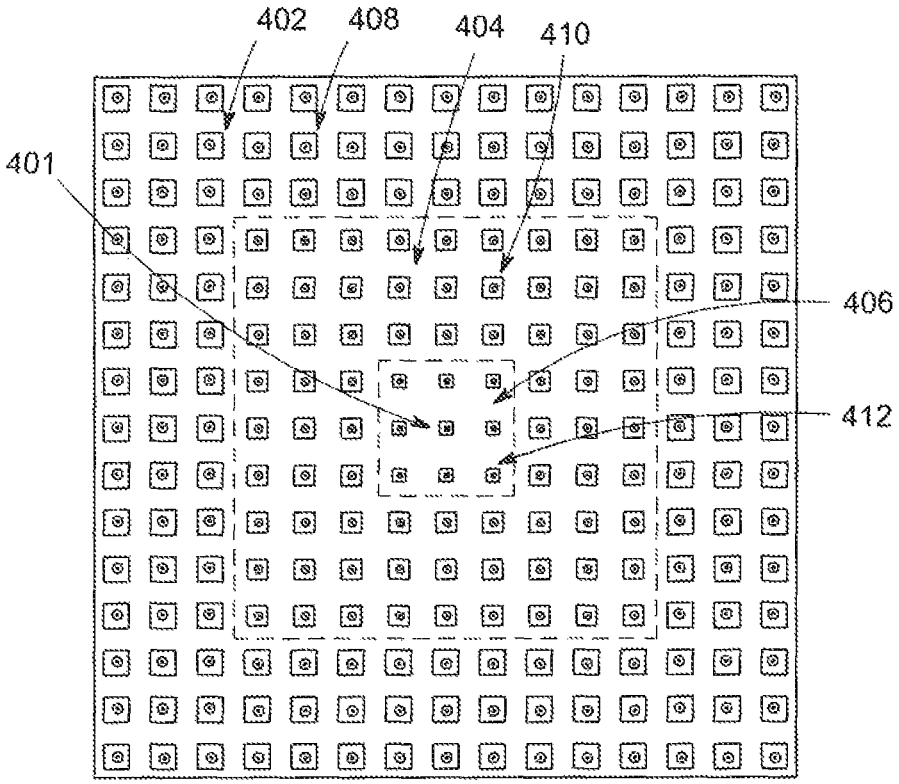
FIG. 4 illustrates a top view of a broadband 3-resonance progressive EBG structure constructed in accordance with an embodiment of the present invention.
Figure 5:
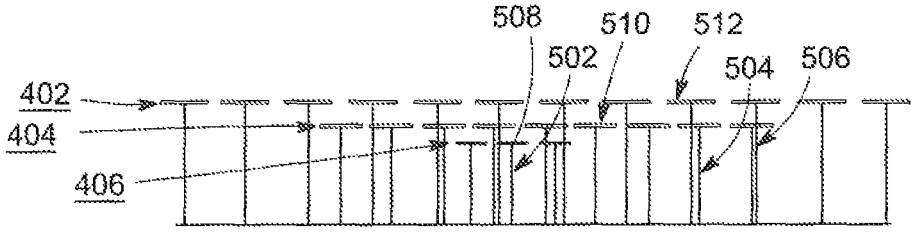
FIG. 5 illustrates a side view enlargement of a portion of the progressive EBG structure shown in FIG. 4 showing a different substrate height for each different patch pattern of the progressive EBG.

FIGS. 4 and 5 illustrate top and side views, respectively, of concentric patterning of three resonance progressive EBG structures, each pattern being provided on a different level, and dimensioned so as to provide, in combination, a continuous broadband phase response, in accordance with an embodiment of the present invention. The dimensions of the cells in each of the three concentric patterns are functions of the corresponding resonance frequencies, including the thickness (t) of the dielectric layer. More specifically, the dimensions of the components of the cells of each pattern are chosen so as to satisfy resonance conditions at a respective one three different frequencies within a desired operational band, using equations 2-4 above. FIG. 4 illustrates three concentric patterns 402, 404 and 406, each pattern comprising square surface elements and corresponding metalized vias, each element having a uniform dimension and spacing, so as to collectively provide a uniform phase response. Note that patterns 402, 404 and 406 are concentric about a center 401. Although concentric patterns are illustrated in this embodiment as being square, other patterns are possible, such as circles, hexagons or other shapes. Additionally, the surface elements of each pattern are illustrated in this embodiment as being square, other patterns are possible, such as circles, hexagons or other shapes. Pattern 402 has uniform unit cells 408 including a structure (such as basically described in FIGS. 1 and 2) so as to provide a predetermined resonance frequency and corresponding reflection phase response. Similarly, patterns 404 and 406 each have uniform unit cells 410 and 412, respectively, so as to provide a respective predetermined phase response for patterns 404 and 406. In accordance with the invention, the combined electrical effect of patterns 402, 404 and 406 is a continuous broadband phase response, as compared with a plurality of adjacently positioned narrowband phase responses as would be provided by a prior art design coupling of a plurality of narrow band EBG structures. Such continuous broadband phase response performance is particularly well-suited for use in conjunction with design of a low-profile antenna having a wide operational bandwidth, exemplary embodiments being shown below with respect to FIGS. 9 and 10.

FIG. 5 illustrates a side view of the FIG. 4 embodiment, and shows the three levels of cells 408, 410 and 412 used to form patterns 402, 404 and 406, as well as the respective metalized vias 502, 604, 506 and the corresponding surface elements (patches) 508 510 and 512.

It should be noted that when surface elements with center pins form the mushroom-like structure of the unit cell, the center pin provides the required inductance as given in equation 4. In an alternative embodiment, instead of the center pins providing the required inductance, there can be no pins and the inductance can be provided by a differently shaped surface element, such as a split-ring, elliptical or even star shape. A benefit of having no center pin is lower manufacturing cost and higher yield.

Figure 6:
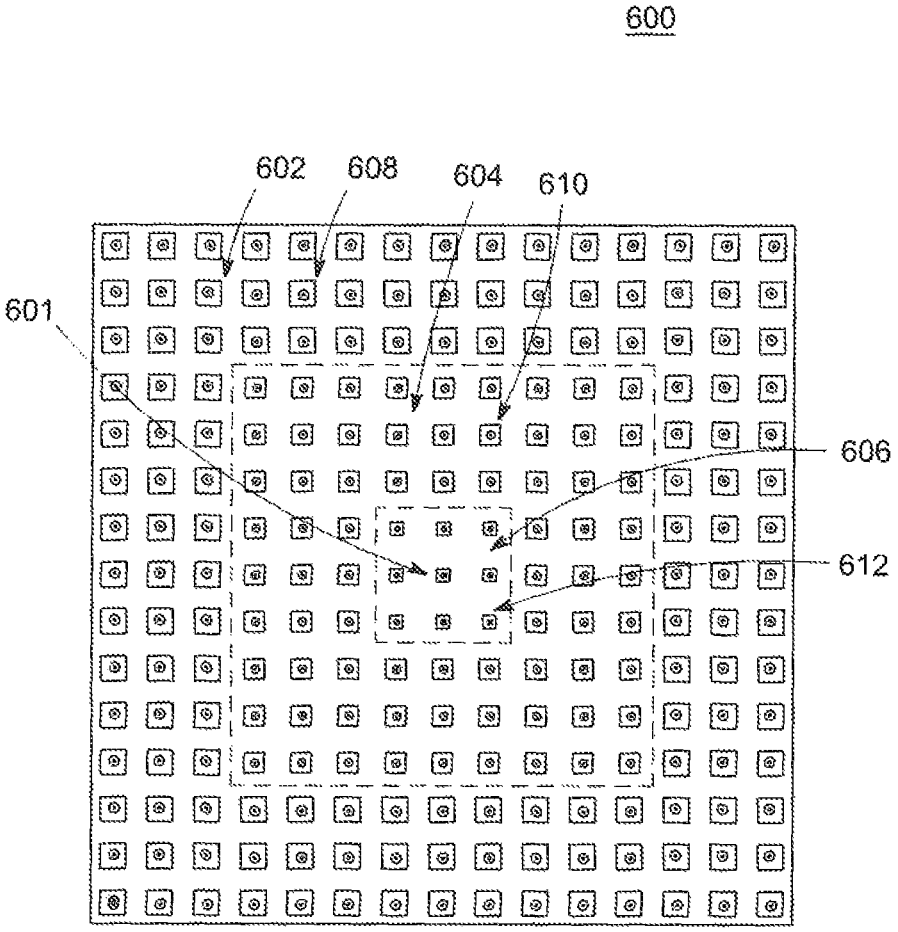
FIG. 6 illustrates a top view of a broadband 3-resonance progressive EBG structure constructed in accordance with another embodiment of the present invention having the same substrate height for each different patch pattern of the progressive EBG.

FIG. 6 illustrates a top view of a broadband three-resonance progressive EBG structure constructed in accordance with another embodiment of the present invention. The EBG structure 600 of FIG. 6 is substantially similar to that shown in FIGS. 4 and 5 in that three concentric square shaped patterns 602, 604 and 606 are shown symmetrically positioned in an adjacent manner about a center cell structure 601. However, the main difference between this EBG structure and the one shown in FIGS. 4 and 5 is that in this EBG structure each of patterns 602, 604 and 606 are arranged at the same height on a common substrate, thereby lowering the complexity, and hence the cost, of manufacturing, as well as increasing the yield. Thus, patterns 602, 604 and 606 each have a uniform basic cell structure illustrated by patch 608, 610 and 612. Illustratively, the substrate may comprise a Duroid 5880 board of about 3 mm thick, patterns 602, 604 and 606 may each comprise a square having sides of about 63 mm, 36 mm and 9 mm, and each pattern may have a square conductive surface elements of 2.5 mm, 1.9 mm and 1.4 mm, respectively. The metalized vies may each have a diameter of about 0.5 mm.

Figure 7:
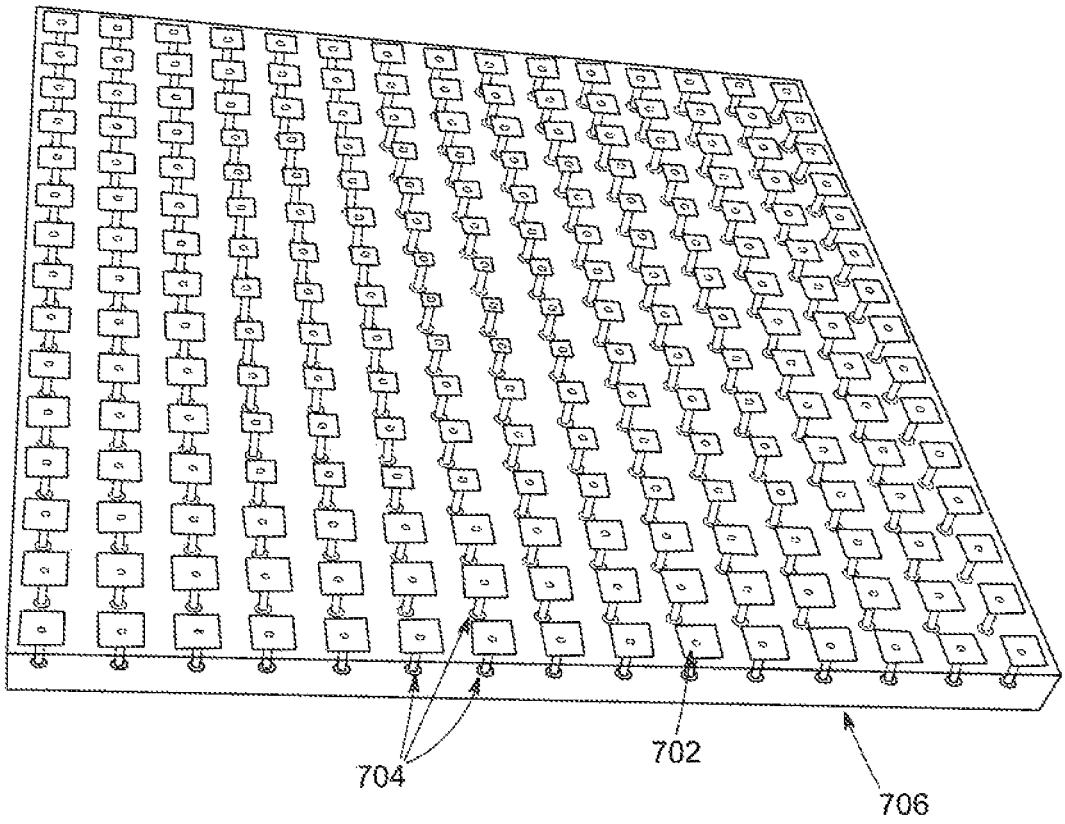
FIG. 7 illustrates a perspective view of a broadband 3-resonance progressive EBG structure shown in FIG. 6.

FIG. 7 illustrates a perspective view of the broadband three-resonance progressive cascade EBG structure of FIG. 6. The EBG cell structure comprises surface elements 702 formed over vias 704 in a dielectric substrate 706 (basically similar to that shown in FIGS. 1 and 2, but where the surface elements are all formed on one level.

Figure 8:
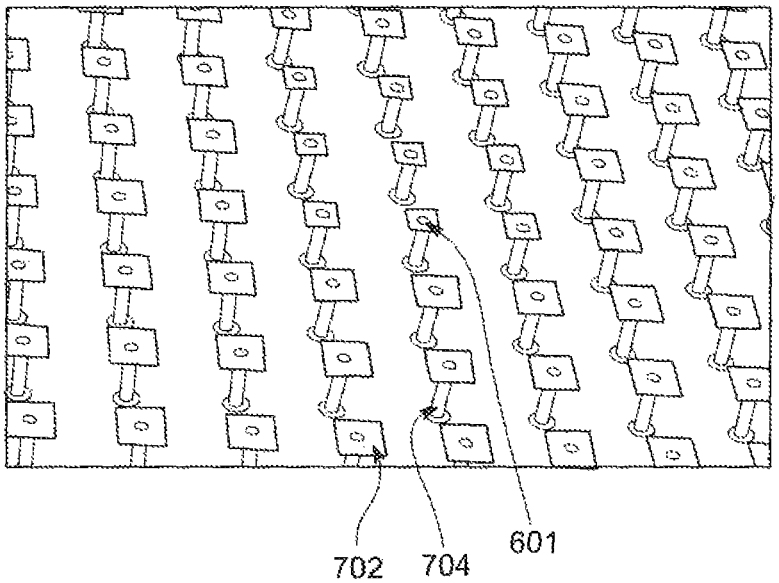
FIG. 8 illustrates an enlargement of a portion of the progressive EBG structure shown in FIG. 7.

FIG. 8 illustrates an enlargement of a portion of the progressive EBG structure shown in FIG. 7, so as to clearly illustrate the uniform height of the cell structures forming each of the cascading patterns.

Figure 9:
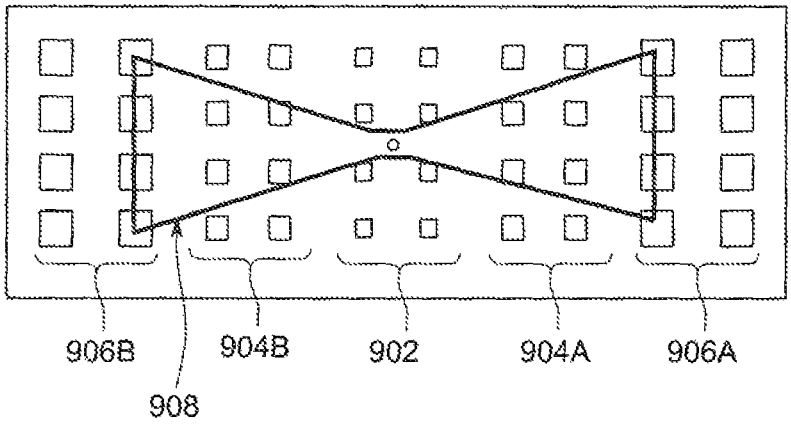
FIG. 9 illustrates a top plan view of a broadband 3-resonance progressive cascade EBG structure constructed in accordance with a further embodiment of the present invention where the cascade of progressive EBG patterns are adjacently positioned, a so called symmetric parallel cascade structure, in conjunction with a bow-tie antenna.

FIG. 9 illustrates a top plan view of a broadband three-resonance progressive EBG structure constructed in accordance with a further embodiment of the present invention. In this design, regions 902, 904 and 906 correspond to patterns having, different resonance frequencies, constructed in accordance with the design criteria previously described, however, they are progressively arranged in a parallel cascade symmetrically in arranged adjacent one another, rather than in a concentric cascade adjacent one another. Thus, patterns 904 and 906 are each sized so as to form a progressive change in phase response in a manner similar to that previously described, but each is divided into two groups, that is pattern 904 is divided into 904A and 904B and pattern 906 is divided into 906A and 906B, so that the A and B groups can be symmetrically positioned in parallel cascade about the center pattern 902.

An EBG structure in accordance with the invention can be used to form low-profile antenna, that is, one where the antenna is placed a distance substantially less than one-quarter wavelength above the top surface of the EBG structure, and preferably, less than about one-tenth of a wavelength. A thin layer of dielectric material deposited over the EBG structure can be used for supporting the antenna. The choice of the concentric versus parallel cascade configuration depends on the type of antenna that is to be placed on the top of the EBG structure. For example, with the arrangement shown in FIG. 9, a dipole antenna 908 (or log periodic) would be appropriate. The dipole antenna 908 can be fed at its center.

Figure 10:
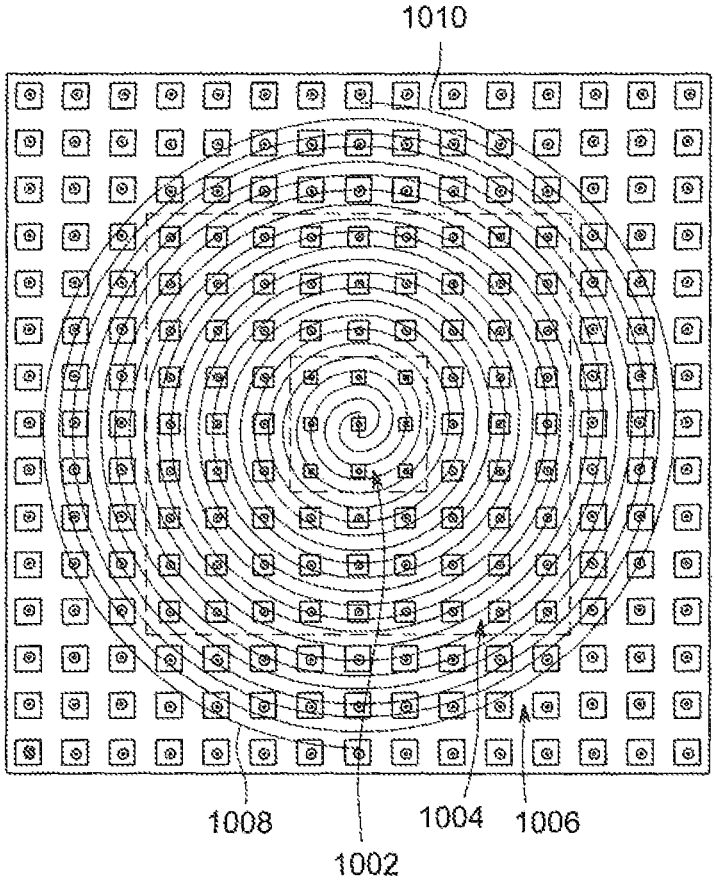
FIG. 10 illustrates a top plan view of a broadband 3-resonance progressive EBG structure constructed in a manner similar to the progressive cascade structure shown in FIG. 6, in conjunction with a spiral antenna.

FIG. 10 illustrates a top plan view of a broadband three-resonance progressive concentric cascade EBG structure constructed in accordance with a further embodiment of the present invention. In this design, regions 1002, 1004 and 1006 correspond to patterns having a progression of different resonance frequencies, constructed in accordance with the design criteria previously described, and arranged similar to that already described with reference to FIG. 6, for example. In this arrangement a low-profile spiral antenna comprising concentric spirals 1008 and 1010 are shown to be an appropriate match for the progressive concentric cascade EBG structure. A thin layer of dielectric material deposited over the EBG structure can be used for supporting the antenna a distance substantially less than one-quarter wavelength above the top surface of the EBG structure, and preferably, less than about one-tenth of a wavelength. The antenna can be fed at the center or at its ends to produce the required sense of circular polarization.

While the foregoing is directed to illustrated embodiments of the present invention, other and further embodiments of the invention may be devised without departing from the basic scope thereof. For example, other embodiments may contain different surface element shapes and sizes for the individual cells, surface elements that are tightly coupled to each other, and surface element without corresponding center pins or vies, the inductance instead being provided by the shape of the surface element, some of which were noted above with respect to FIGS. 4 and 5.

The invention claimed is:

1. An electromagnetic bandgap structure comprising:

a progressive cascade of a plurality of patterns of electromagnetic bandgap cells, adjacently positioned in a parallel manner about a center pattern, the cells of each pattern being dimensioned so that each pattern has a reflection phase response centered at a different, but closely-spaced, frequency compared with the reflection phase response of an adjacently positioned pattern, and each pattern is formed on a dielectric substrate so that the combined reflection phase response of the plurality of patterns provides a continuous wideband operational range.

2. The electromagnetic bandgap structure of claim 1, wherein each pattern comprises a plurality of unit cells patterned on a dielectric substrate.

3. The electromagnetic bandgap structure of claim 2, wherein the cells of each pattern have one or more characteristics that cause each pattern to have a respective predetermined resonance and reflection phase response which is different from, but closely spaced to, the resonance and reflection phase response of an adjacent pattern.

4. The electromagnetic bandgap structure of claim 3, wherein each cell comprises a conductive surface element having a given shape and spacing to an adjacent surface element so as to form a capacitive element on the dielectric substrate and coupled with a metalized via that passes underneath the surface element and through the dielectric substrate so as to form an inductive element.

5. The electromagnetic bandgap structure of claim 3, wherein each cell comprises a conductive surface element having a given shape and spacing to an adjacent surface element so as to form both a capacitive element and an inductive element on the dielectric substrate.

6. The electromagnetic bandgap structure of claim 1, further including an antenna positioned above the electromagnetic bandgap structure.

7. The electromagnetic bandgap structure of claim 6, wherein the antenna is positioned above the electromagnetic bandgap structure in a space substantially less than one quarter of the wavelength of a frequency in the operational range.

8. The electromagnetic bandgap structure of claim 6, wherein the antenna is positioned above the electromagnetic bandgap structure at a level approximately one tenth or less of the wavelength of a frequency in the operational range.

9. The electromagnetic bandgap structure of claim 6, wherein the antenna is a dipole and the patterns of the electromagnetic bandgap structure are adjacently positioned in a symmetric parallel manner about a center pattern.

* * * * *